US007694697B2

(12) United States Patent
Lindenmueller et al.

(10) Patent No.: US 7,694,697 B2
(45) Date of Patent: Apr. 13, 2010

(54) APPARATUS FOR FORMING A SELVEDGE ON A GRIPPER WEAVING MACHINE

(75) Inventors: Walter Lindenmueller, Lindau (DE); Leo Krez, Lindau (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 0 days.

(21) Appl. No.: 12/227,779

(22) PCT Filed: Apr. 20, 2007

(86) PCT No.: PCT/DE2007/000695

§ 371 (c)(1),
(2), (4) Date: Nov. 25, 2008

(87) PCT Pub. No.: WO2007/137544

PCT Pub. Date: Dec. 6, 2007

(65) Prior Publication Data

US 2009/0090426 A1 Apr. 9, 2009

(30) Foreign Application Priority Data

May 31, 2006 (DE) ..... 10 2006 025 265

(51) Int. Cl.

| | |
|---|---|
| ***D03D 47/36*** | (2006.01) |
| ***D03D 45/16*** | (2006.01) |
| *D03D 47/38* | (2006.01) |
| *D03D 47/48* | (2006.01) |

(52) U.S. Cl. ..... 139/453; 139/116.1; 139/170.4; 139/256 A

(58) Field of Classification Search ..... 139/1 R, 139/116.1, 429, 430, 438, 439, 443, 444, 139/446, 447, 449, 450, 452, 453, 170.3, 139/170.4, 170.6, 194, 224 R, 232 R, 256 R, 139/257, 263, 256 A, 224 A
See application file for complete search history.

(56) References Cited

U.S. PATENT DOCUMENTS 4,143,684 A * 3/1979 Lindenmuller et al. ..... 139/450

(Continued)

FOREIGN PATENT DOCUMENTS

DE 24 54 207 5/1975

(Continued)

*Primary Examiner*—Bobby H Muromoto, Jr.
(74) *Attorney, Agent, or Firm*—W. F. Fasse; W. G. Fasse

(57) ABSTRACT

The invention relates to a method and an apparatus for forming an insertion-side fabric selvedge (35) on a gripper weaving machine, whereby: a) selectively one of several weft threads (3, 4, 43, 44) that are provided on bobbins (1, 2, 41, 42) is positioned in the running path (5) of a gripper (6), while the other weft threads (3, 4, 43, 44) are held outside of the running path, whereby: b) the weft thread positioned in the running path is grasped and inserted into a loom shed by the gripper (6), whereby: c) thereafter the inserted weft thread (3) is beat-up against a binding line (33) by means of a weaving reed (31), whereby: d) the inserted weft thread (3) is cut-off on the insertion side directly after the beat-up, and e) the bobbin-side weft thread end of a respective cut-off weft thread (3) is respectively grasped and held by a different suction chamber of a suction chamber block (10, 20).

11 Claims, 3 Drawing Sheets

U.S. PATENT DOCUMENTS

Figure 1:
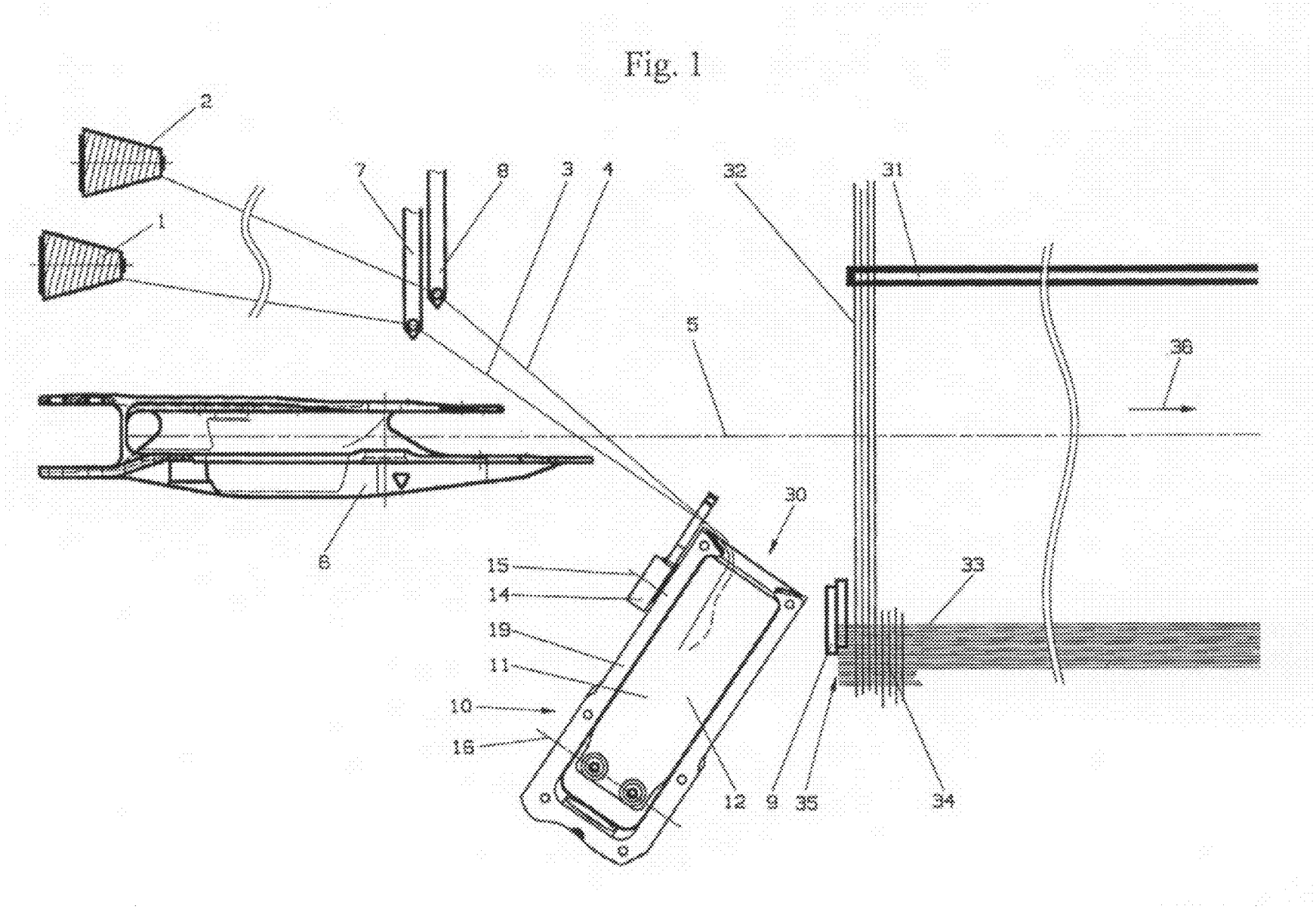

| | | | | | |
|---|---|---|---|---|---|
| 4,540,028 | A | * | 9/1985 | Gehring et al. | 139/453 |
| 4,702,284 | A | * | 10/1987 | Gehring | 139/446 |
| 4,756,343 | A | * | 7/1988 | Angebault et al. | 139/443 |
| 4,834,147 | A | * | 5/1989 | Eberle et al. | 139/450 |
| 4,840,203 | A | * | 6/1989 | Moeneclaey et al. | 139/453 |
| 4,913,195 | A | * | 4/1990 | Speich | 139/446 |
| 4,957,145 | A | * | 9/1990 | Verclyte et al. | 139/434 |
| 5,005,609 | A | * | 4/1991 | Volland et al. | 139/116.2 |
| 5,172,735 | A | | 12/1992 | Kleiner | |
| 5,492,153 | A | | 2/1996 | Stacher et al. | |
| 5,996,647 | A | * | 12/1999 | Krumm | 139/54 |
| 6,058,980 | A | * | 5/2000 | Scari et al. | 139/302 |
| 6,129,123 | A | * | 10/2000 | Ludwig et al. | 139/116.2 |

FOREIGN PATENT DOCUMENTS

| | | |
|---|---|---|
| DE | 25 15 609 | 10/1976 |
| DE | 31 37 831 | 3/1983 |
| DE | 34 18 764 | 9/1985 |
| EP | 0 240 075 | 10/1987 |
| EP | 0 478 986 | 4/1992 |
| EP | 0 644 286 | 3/1995 |
| EP | 0 878 570 | 11/1998 |
| EP | 0 898 001 | 2/1999 |
| GB | 1 392 329 | 4/1975 |

* cited by examiner

APPARATUS FOR FORMING A SELVEDGE ON A GRIPPER WEAVING MACHINE

The invention relates to a method and an apparatus for forming a selvedge on gripper weaving machines or looms with the features according to the patent claims 1 and 4.

Known methods and apparatuses for forming a selvedge on gripper weaving machines, during weaving with several weft threads provided on separate spools or bobbins, provide a so-called catch or auxiliary selvedge on both sides of the woven cloth or fabric, that is to say on the picking or insertion side and on the drawing-out side of the weft thread. For such a catch selvedge, additionally a number of auxiliary warp threads are arranged laterally outside of the main warp threads for the actual woven fabric. Also the auxiliary warp threads are subjected to a shedding motion, and the weft thread is laid-in with its free end between these auxiliary warp threads, is bound-off and held by these. In this manner, a narrow auxiliary woven strip, also called a catch selvedge, is produced.

The catch selvedge has the purpose to catch or to hold the inserted weft thread. During the weaving, the catch selvedge on the insertion side holds the bobbin-side weft thread end of each weft thread so long until the associated weft thread, dependent on the repeat i.e. the weaving pattern, is again inserted. Thus, a weft thread that is not inserted over several weft insertion cycles runs along in the insertion-side catch selvedge, until it is again inserted.

The catch selvedges are subsequently again separated from the actual woven fabric, and form a thread waste. If one considers the production capacity of a modern gripper weaving machine, a considerable amount of losses arises due to this thread waste, especially during weaving with high-valued, expensive yarns.

An apparatus for reducing these losses is know from the DE 34 18 764 C1. According to this apparatus, the auxiliary warp threads necessary for forming the catch selvedge are guided through a separate auxiliary weaving reed. Besides the normal beat-up motion coupled with the main weaving reed, this auxiliary weaving reed further additionally carries out a lateral sliding motion directed outwardly. Thereby a cutting alley or gap is formed between woven fabric and catch selvedge during the beat-up. The weft thread length needed for the cutting alley or gap is pulled into the catch selvedge from the selvedge waste protruding outwardly beyond the catch selvedge, and thereby the weft thread waste is reduced by the measure of the cutting alley or gap width.

A further reduction of the thread waste in the catch selvedge is achieved with an apparatus and a method that is described in the EP 0 878 570 A1. According to this document, the catch selvedge is formed by two leno warp threads with the aid of a rotational leno selvedge forming device. In that regard, through the use of the full rotational leno technology, the thread waste is thereby reduced in that only two leno warp threads are still needed instead of several auxiliary warp threads in the catch selvedge, and in that the weft thread length is shortened in the narrow catch selvedge.

Finally, a method for the cutting of the cloth edge or selvedge of a woven fabric on a shuttle-less weaving machine is known from the DE 31 37 831 A1, in which the use of a catch or auxiliary selvedge is entirely avoided. After the insertion, the inserted weft thread is cut-off on the insertion side, and the fabric-side weft thread ends are subsequently cut-off again. Thereby a thread waste arises once again. The DE 31 37 831 A1 describes a method for weaving with one weft color, and does not disclose how the bobbin-side weft threads that are cut-off after the weft thread insertion are provided to the gripper at the proper time and at a suitable location for the next weft insertion. Especially during weaving with several provided weft threads, the so-called multicolor weaving, this is not easy to accomplish. In the multicolor weaving, several weft threads are pulled or drawn off from various different supply bobbins and are simultaneously held ready for the weft insertion. The weft threads are, however, inserted sequentially one after another into the loom shed by the gripper. In order that the gripper grasps the respective correct weft thread and inserts it into the loom shed, the weft thread to be inserted is moved by a thread presenting or reaching-in element into the running path of the gripper from the thread or yarn sheet of weft threads held ready next to the gripper running path. In this manner, for example patterned woven fabrics with various different colored weft threads can be produced. It is, however, also possible to process weft threads of the same type and color from various different bobbins next to one another, in order to thereby achieve a higher failure security and a lower personnel effort through longer exchange intervals for the bobbin exchange. Also this type of weaving is called multicolor weaving.

The object of the present invention is to provide and operationally secure method and an apparatus for multicolor weaving on a gripper weaving machine, with which the thread waste is kept as small as possible.

The object is achieved according to the invention by a method with the features according to patent claim 1 and by an apparatus with the features according to patent claim 4. Further developments suitable for the purpose are defined in the respective dependent claims.

According to the invention, for forming an insertion-side fabric selvedge on a gripper weaving machine, first one of several weft threads supplied and held ready on bobbins is positioned in the running path of a gripper, while the other weft threads are held outside of the running path. The weft thread positioned in the running path of the gripper is grasped by the gripper and inserted in a loom shed, and after the insertion is beat-up against a binding or interlacing line by means of a weaving reed. The binding or interlacing line corresponds to the woven fabric edge, along which the lastly inserted and beat-up weft thread is arranged. The inserted weft thread is cut-off on the insertion side directly after the beating-up. When cutting off the weft thread on the insertion side of the weaving machine, two weft thread ends arise. Firstly, a fabric-side weft thread end which forms the left fabric edge or selvedge, and secondly a bobbin-side weft thread end which is still connected with the bobbin after the cutting-off of the weft thread. According to the invention, now the bobbin-side weft thread end of a respective cut-off weft thread is grasped and held respectively by a different suction chamber of a suction chamber block. During the next weft insertion from the same bobbin, the bobbin-side weft thread end is inserted as the forward end of the weft thread into the loom shed and then forms the fabric edge or selvedge on the drawing-out side of the weaving machine.

Preferably the described method steps are repeated multiple times, so that a woven fabric with an insertion-side fabric edge or selvedge arises, without a thread waste arising on the insertion side.

The essential advantage of the present method is that the use of a catch selvedge is avoided even for multicolor weaving, and thereby a considerable material savings is achieved. This is achieved by the insertion-side suction chamber block with suction chambers, which grasps the bobbin-side weft thread ends separately from one another after the cutting-off of the inserted weft thread, and holds the bobbin-side weft thread ends so long until the respective weft thread is again inserted. Thereby entanglings or catchings of the neighboring weft threads are avoided. This is advantageous because especially rough yarns have a tendency, during contact with other yarns, to stick to one another due to entanglings or catchings. By the weft thread ends being grasped and held separate from one another it is prevented, and that other weft threads have become entangled or stuck with the weft thread to be inserted, the gripper after grasping the weft thread to be inserted pulls along still further weft threads in the direction of the loom shed. A weft thread that is unintentionally pulled along would cause production interruptions or faults or defects in the woven fabric.

The selection of the respective weft thread to be inserted is achieved, as known per se, according to a prescribed weaving pattern. The weaving pattern is held or stored in the form of a so called weaving pattern repeat in the control of the weaving machine.

For positioning the respective weft thread in the running path of the gripper, for example, driven thread presenting or reaching-in elements in the form of thread presenting or reaching-in needles are utilized, at the free end of which respectively an eyelet is arranged, through which the associated weft thread is guided. The reaching-in needles are advantageously electric motor driven and controlled by the weaving machine control, in order to reach-in or present the respective weft thread at the correct time to the gripper for the weft thread insertion, that is to say to position the weft thread in the running path of the gripper. For that purpose, for example, reference is made to the apparatus according to patent document EP 0 478 986 B1, in which so-called thread presenters are set forth as reaching-in elements. It is, however, also possible to derive the drive for the reaching-in elements from the main drive of the weaving machine. In this case, the motion of the reaching-in elements can be controlled, for example, by a cam disc transmission.

The gripper is generally secured at the forward end of a gripper band or a gripper rod, and can comprise an actively operated or actuated gripper clamp or a passive gripper clamp.

The suction chamber block operates in such a manner that the cut-off bobbin-side weft thread end is grasped and held by an airstream. The airstream can be adjustable with respect to the volume flow and the time, especially in order to advantageously influence the behavior of various different types of weft yarns in the airstream. For the operator of the weaving machine, this makes it possible to achieve such an adjustment so that the airstream is strong enough in order to securely grasp and to hold the weft threads, and simultaneously not so strong that the weft thread ends are damaged by the airstream. Depending on the yarn characteristics of the weft threads, the suction chamber block is arranged so that the weft thread end that is held in the suction chamber after the grasping is between a few millimeters and several centimeters long. A long weft thread end in the suction chamber requires a smaller holding suction pressure, a short weft thread end requires a higher holding suction pressure in the suction chamber. In that regard, the required holding suction pressure is also dependent on the diameter and the roughness of the weft threads.

According to a preferred embodiment of the method, the suction chamber block, by means of a movable element, respectively makes available a different suction chamber for each weft thread. The function and possible embodiment forms of the movable element are explained in further detail in the following description of the apparatus according to the invention.

For carrying out the method, an apparatus for forming an insertion-side fabric edge or selvedge on a gripper weaving machine is set forth, with which at least two weft threads that are pulled or drawn off from different bobbins are sequentially inserted by at least one gripper into a loom shed formed of warp threads, and are cut off on the insertion side by a scissors or cutter arranged close to the outermost warp thread. Close to the cutter, a suction chamber block for holding the bobbin-side weft thread ends is provided, which suction chamber block is divided into individual suction chambers for the separate grasping and holding of each weft thread, whereby a suction chamber is allocated to each weft thread and whereby the respective suction chamber can be provided or made available to the respective weft thread by means of a movable element.

The term scissors or cutter is to be understood as covering every type of suitable separating device, for example it can also involve a thermal separating device such as a melting wire device or a laser separating device.

A preferred embodiment of the invention relates to an apparatus for weaving with two weft threads. In that regard, the movable element comprises a tilting or pivoting flap provided in the interior of the suction chamber block. By means of the controlledly switchable pivoting flap, the suction chamber block is divided into two suction chambers. Each of the suction chambers is allocated to one of the two weft threads. Thereby the separate grasping and holding of the two weft thread ends is made possible, and thus a mutual entangling or sticking together of the weft threads is avoided. The entangling or sticking together of the weft threads would lead to undesired interruptions of the weaving process or to faults or defects in the woven fabric.

A further aspect of the invention relates to the controlled movement of the switchable pivoting flap. Preferably this movement is synchronized with the movements of reaching-in elements. By means of the reaching-in elements, the respective weft thread to be inserted is moved into the path of the gripper that is driving or moving in the direction of the loom shed, so that the gripper can securely grasp and insert the correct weft thread. In that regard it is important that the weft thread that is not to be inserted is held completely out of the path of the incoming gripper, so that it does not give rise to collisions between weft threads that are not to be inserted and elements of the gripper. Due to the movement of the pivoting flap that is synchronized with the movement of the reaching-in element, on the one hand it is possible to position the weft thread, that is to be inserted, optimally in the path of the gripper, because the weft thread end in the suction chamber block follows the movement of the pivoting flap, and on the other hand the weft thread that is not to be inserted is held clear out of the path of the gripper. Possible embodiments of the reaching-in elements are already described above in the description of the method according to the invention.

For the further improvement of the guidance and positioning of the respective weft thread, a separating lever is pivotably arranged preferably close to the suction opening of the suction chambers. The separating lever is operated or actuated essentially synchronously with the pivoting flap, so that the two weft thread ends are grasped and held surely separated from one another.

A further preferred embodiment of the invention encompasses a movably arranged suction chamber block with several suction chambers. After the cutting-off of the inserted weft thread, the end of the bobbin-side weft thread part is guided to the allocated suction chamber, in that the entire suction chamber block is moved in such a manner so that the weft thread that is to be grasped is provided or made available to the suction chamber allocated to it. In that regard, the movable element is a part of a drive for the suction chamber block. This drive can, for example, be an electric motor drive. The drive is connected with a weaving machine control via a signal-transmitting line, whereby the weaving machine control in this manner controls the movements of the movable element and therewith of the suction chamber block. Through the movement of the entire suction chamber block, each suction chamber is moved in a targeted manner to the weft thread allocated to it, in order to grasp the bobbin-side weft thread part after the cutting-off of the inserted weft thread, separately from the other weft threads. In this manner, each weft thread is grasped and held separately by a suction chamber. An entangling or sticking-together of the weft thread ends is thereby prevented.

A preferred embodiment of the movably arranged suction chamber block is a tiltably or pivotably arranged suction chamber block with a further preferable circular or circular segment shaped cross-section that is divided into several circular segment shaped suction chambers. In this embodiment, the movable element can, for example, be the rotor shaft of an electric motor rotation drive, whereby the rotation axis of the rotor shaft is arranged extending in a plane perpendicular to the circular or circular segment shaped cross-section and through the center point of the circle or of the circular segments.

The suction chambers can also be embodied so that they can be acted or impinged on with suction air in an individually controlled manner. In combination with additional mechanical holding means, it is then possible to reduce the required quantity of suction air, in that the individual suction chambers are impinged or acted on with a higher volume flow of suction air in a time limited manner only for grasping the weft thread ends. Thereafter, for example, the thread can be held by a smaller volume flow of suction air. Especially for weaving with a large number of weft colors, this embodiment has an advantageous influence on the air consumption.

The invention can also be combined with a selvedge tucking or laying-in apparatus. In that regard, the fabric edge or selvedge that is formed after the cutting-off of the inserted weft thread is further fabricated into a laid-in or tucked selvedge by laying-in or tucking of the fabric-side weft thread end into the loom shed that has again been opened for the next weft insertion. Both mechanical as well as pneumatic selvedge tucking apparatuses are sufficiently known and are therefore not described in further detail here.

The present invention furthermore encompasses a weaving machine that is characterized by one of the above mentioned apparatuses.

The invention and further arising advantages are explained in further detail in the following in connection with several example embodiments.

Figure 2:
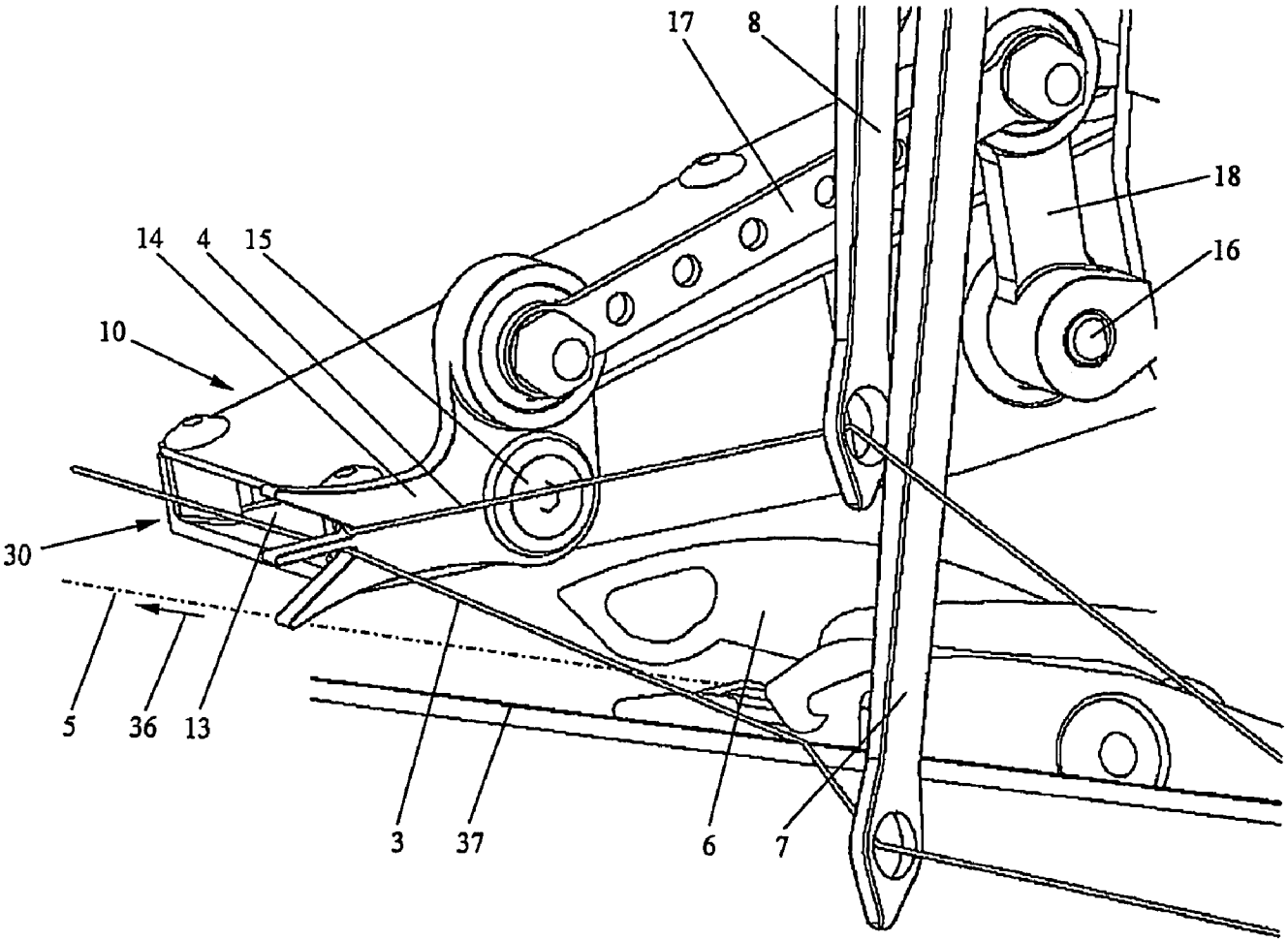
Figure 3:
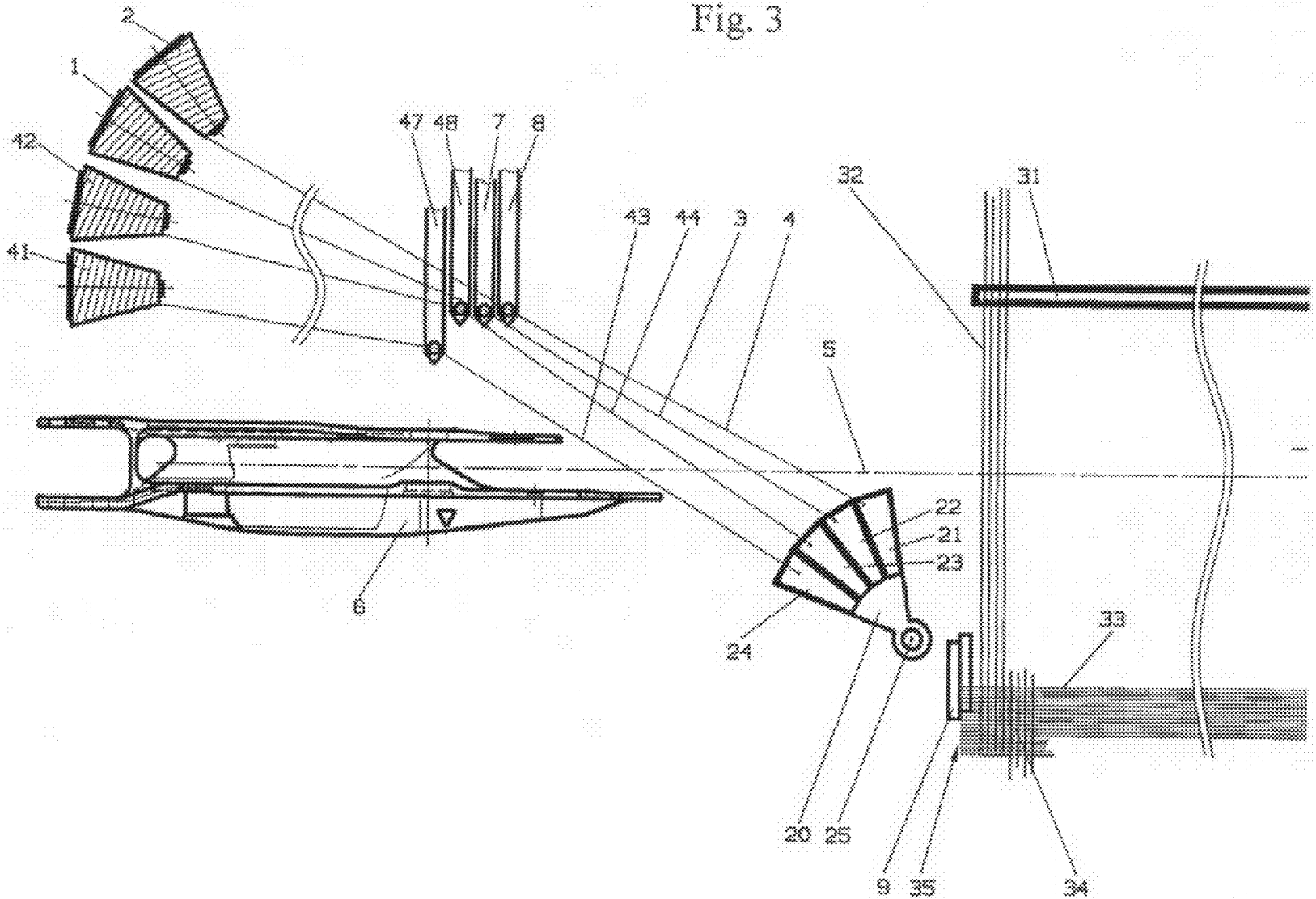

The accompanying figures show:

FIG. 1 the schematic illustration of an inventive arrangement with a first embodiment of the suction chamber block, FIG. 2 a perspective illustration of the weft insertion side according to the arrangement of FIG. 1 with suction chamber block, and FIG. 3 the schematic illustration of an inventive arrangement with a second embodiment of the suction chamber block.

The arrangement illustrated in FIG. 1 shows the weft threads 3 and 4 that are pulled or drawn off from the bobbins 1 and 2 and are provided or held ready for the weft insertion. The reaching-in elements 7, 8 move selectively one of the two weft threads 3, 4 essentially in the vertical direction into the horizontally arranged running path 5 of the gripper 6. The gripper 6 moves on the running path 5 in the insertion direction represented by the arrow 36 into the loom shed formed by the warp threads 32. The suction chamber block 10 is arranged between the gripper 6 and the loom shed formed of the warp threads 32. The essential parts of the suction chamber block are the housing 19, which is illustrated in FIG. 1 without lid or cover, so that an upper suction chambers 12 arranged in the suction chamber block and a pivoting flap 11 are visible. The pivoting flap 11 separates the interior space of the suction chamber block into the upper suction chamber 12 and a lower suction chamber 13. The lower suction chamber 13 is not visible in this view, because it is arranged under the upper suction chamber 12 and is covered by the pivoting flap 11. The pivoting flap 11 is installed to be pivotable about the rotation axis 16 in the suction chamber block in such a manner so that, dependent on its pivoting position, it uncovers the suction opening 30 substantially or for the most part for the upper suction chamber 12 or for the lower suction chamber 13.

In the situation illustrated in FIG. 2, the pivoting flap 11, which is not visible, is located in the upper position, so that the suction opening 30 is substantially or for the most part uncovered for the lower suction chamber 13.

A separating lever 14 is arranged on the section chamber block 10 near the suction opening 30 of the suction chambers 12, 13. Separating fingers with guide grooves lying therebetween are arranged on the front end of the separating lever 14. A weft thread 3, 4 is respectively guided in each guide groove. The separating lever 14 is secured pivotably about the rotation axis 15 on the housing 19 of the suction chamber block. The separating lever 14 is drive-connected with the rotation axis 16 of the pivoting flap 11 via a mechanical rod linkage consisting of the levers 17, 18 and several deflecting elements, in such a manner that the separating lever 14 moves in a synchronous and forced manner with the pivoting flap 11. A drive of the pivoting flap 11 is not shown in the figures. The most varied known drives may, however, be utilized, such as, for example, an electric, pneumatic or hydraulic drive. An advantageous simple embodiment is provided, for example, by an electric rotation drive that is connected in a rotationally fixed manner with the rotation axis 16. This rotation drive is preferably connected in a signal transmitting manner with the control of the weaving machine, so that the pivoting flap 11 is driven in a controlled manner. Via the rod linkage 17, 18, also the separating lever 14 is driven synchronously with the pivoting flap 11.

A scissors or cutter 9 is arranged between the suction chamber block 10 and the loom shed near the outermost warp thread approximately at the height of the binding or interlacing line 33. The binding or interlacing line 33 is the connection of all so-called binding or interlacing points at which the just-inserted weft thread 3 is beat-up against the already finished woven web or fabric 34 by the weaving reed 31.

In the illustrated situation, the weaving reed 31 is already returned to its retracted position after the beat-up against the binding or interlacing line 33. The last beat-up weft thread 3 is already cut off and the weft thread end has been pulled into the corresponding lower suction chamber 13. Because the lower suction chamber 13 is covered by the pivoting flap 11 lying thereabove, the weft thread end pulled into this suction chamber 13 is not visible and is illustrated with a dashed line.

The manner of functioning of the inventive apparatus is described in the following.

For the insertion of a weft thread 3, first the reaching-in element 7 moves downwardly and pulls the weft thread 3, which is threaded into a thread eyelet of the reaching-in element 7, into a position in which the weft thread 3 crosses the horizontally arranged running path of the gripper 6. During that, the end of the weft thread 3 is held fast in the lower suction chamber 13 of the suction chamber block 10. In order to ensure an exact reproducible position of the reached-in weft thread 3 in the running path 5 of the gripper, a thread presenting or reaching-in edge 37 is provided between the reaching-in elements 7, 8 and the running path 5 of the gripper 6. The reaching-in elements 7, 8 position the presented or reached-in weft thread 3 below the reaching-in edge 37, so that the presented or reached-in weft thread 37 is deflected on the reaching-in edge 37, and so that the reaching-in edge 37 in every case determines the vertical position of each presented or reached-in weft thread 3, 4.

Thereafter the gripper 6 moves on its running path 5 in the insertion direction represented by the arrow 36, and thereby grasps the presented or reached-in weft thread 3. The weft thread 3 is clamped fast in a weft thread clamp of the gripper 6. The continuously moving gripper 6 pulls the end of the weft thread 3 out of the lower suction chamber 13 of the suction chamber block 10 and transports the weft thread 3 into the loom shed. After the transfer of the weft thread 3 in the middle of the loom shed to a receiver gripper arranged on the opposite side, the gripper 6 again moves out of the loom shed into its starting position, while the receiver gripper pulls the weft thread 3 through the entire loom shed.

The suction chamber block 10 is arranged near the running path of the gripper 6, so that in connection with the grasping of the weft thread 3 that is to be inserted only the shortest possible weft thread end protrudes beyond the gripper 6. This protruding weft thread end forms a thread waste on the drawing-out side of the woven fabric 34 and therefore should be as short as possible. An actively operating gripper clamp makes a very short protruding weft thread end possible, in that the gripper clamp is first closed only when the gripper 6 on the path in the direction of the loom shed has the minimum spacing distance from the suction chamber block 10.

Through a further time delay during the closing of the gripper clamp, the protruding weft thread end can actually still be shortened further by the so-called looping-out. In that regard, the gripper 6 moving in the insertion direction 36 pulls the weft thread 3 or 4, which has already been grasped but not yet clamped, out of the suction chamber block 10, and only tightly clamps the weft thread end shortly before it is entirely pulled out of the suction chamber block 10. In order that the looping-out functions reliably, the weft thread 3 coming from a bobbin 1 is clamped by a thread clamp, which is not visible and which is arranged between bobbin 1 and reaching-in element 7, at least so tightly so that no weft thread 3 is pulled in a following manner from the bobbin 1 during the looping-out of the weft thread end out of the suction chamber block 10. That is to say, the clamping force of the thread clamp must be greater than the holding force of the suction chamber block 10.

After the weft thread 3 has been pulled completely into the loom shed, it is beat-up against the binding or interlacing line 33 by the weaving reed 31. Simultaneously the loom shed closes, so that the warp threads 32 of the loom shed bind-off the inserted weft thread 3. Directly after the binding-off, the weft thread 3 is cut-off on the insertion side by the scissors 9 near the outermost warp thread.

The suction chamber block 10 is now arranged on the weaving machine in such a manner so that a weft thread beat-up against the binding or interlacing line 33 runs directly past the suction opening 30 of the suction chambers. Thereby it is ensured that the bobbin-side end of the weft thread 3, immediately after the cutting-off by the scissors 9, is grasped by the airstream of the suction chamber block and is pulled into the corresponding suction chamber 13.

The reliable grasping of the bobbin-side weft thread end after the cutting-off of the beat-up weft thread in the suction chamber allocated to this weft thread is ensured by the function of the pivoting flap 11 and of the separating lever 14. For that purpose, the movements of the pivoting flap 11 and of the separating lever 14 are coordinated by the weaving machine control with the movements of the other components taking part in the weft insertion, such as, for example, the gripper and the reaching-in elements 7 and 8. The pivoting flap 11 and the separating lever 14 stand either in an upper or in a lower position during weaving with two weft colors. Intermediate positions are not provided.

During the insertion of the weft thread 3, the pivoting flap 11 stands in its upper position, as it is shown in FIG. 2. The suction opening 30 is thus uncovered substantially or for the most part for the lower suction chamber 13 allocated to the weft thread 3, and the airstream sucks the end of the cut-off weft thread 3 into the lower suction chamber 13. Oppositely, the pivoting flap 11 stands in its lower position during the insertion of the weft thread 4, so that the airstream is guided essentially through the suction chamber 12, and the end of the weft thread 4 is grasped and held by the suction chamber 12.

The separating lever 14 separates the two weft threads 3, 4 outside of the suction chamber block and positions the corresponding weft thread optimally in front of the suction opening 30, so that each weft thread end is sucked into the suction chamber 12 or 13 that is allocated to it. For that purpose, the separating lever 14 is pivoted about its rotation axis 15 between an upper and a lower position, synchronously to the movements of the pivoting flap 11.

The arrangement according to FIG. 3 is differentiated from the arrangement according to FIG. 1 by the embodiment of the suction chamber block 10 or 20. The suction chamber block 10 according to FIGS. 1 and 2 is provided for the weaving with two weft colors. In contrast, the suction chamber block 20 illustrated in FIG. 3 and claimed in the claims 10 and 11 is also suitable for the weaving with more than two weft colors. Also here it involves a suction chamber block in which a separate suction chamber 21, 22, 23, 24 is provided for each weft color, i.e. for each weft thread. The illustrated embodiment enables the weaving with four weft colors, because thereby each weft thread still can be separately grasped and held by a suction chamber 21, 22, 23, 24 allocated to it. In order to carry out the allocation between the individual weft threads 3, 4 and the suction chambers 21, 22, 23, 24, the entire suction chamber block 20 is tilted or pivoted about the pivot axis 25 arranged essentially vertically. The grasped weft thread ends are then held in the corresponding, similarly vertically arranged suction chambers 21, 22, 23, 24. In the illustrated situation, the weaving reed 31 is already returned to its retracted position after the beating-up against the binding or interlacing line 33. The last beat-up weft thread 43 is already cut-off, and the weft thread end has been pulled into the allocated suction chamber 24.

The invention claimed is:

1. Gripper weaving machine for multicolor weaving, with which at least two weft threads pulled off from different bobbins are sequentially one after another inserted by at least one gripper into a loom shed formed of warp threads and are cut-off on the insertion side by a separating device, with at least two driven reaching-in elements that position, in the running path of the gripper, the weft thread that is respectively to be inserted, and with an arrangement for grasping and holding the weft thread ends remaining on the bobbins after the cutting-off, wherein this arrangement is arranged near the separating device, whereby these weft thread ends are grasped and held separately from one another, and for the insertion of a weft thread selectively one of several weft threads is brought into the running path of the gripper by one of the reaching-in elements, while the other weft threads are held outside of the running path, characterized in that a) a suction chamber block (10, 20) is provided as the arrangement for the grasping and holding of the weft thread ends remaining on the bobbins (1, 2) after the cutting-off, wherein the suction chamber block is divided into at least two suction chambers (12, 13; 21, 22, 23, 24) which respectively grasp one weft thread (3, 4, 43, 44) and hold it, and each of which is allocated to a certain weft thread end, b) at least two suction chambers (12, 13) are made ready by a movable element that comprises a pivoting flap (11) provided in the interior of the suction chamber block (10), and c) for weaving with more than two weft threads (3, 4, 43, 44) pulled off from different bobbins (1, 2, 42, 43), the entire suction chamber block (20) is arranged to be movable by means of a movable element that is a part of a drive for the suction chamber block (20), in such a manner that each weft thread (3, 4, 43, 44) is allocated to a different suction chamber (21, 22, 23, 24).

2. Gripper weaving machine according to claim 1, characterized in that the pivoting flap (11) can be switched-over in a controlled manner, and the controlled switching-over of the pivoting flap (11) is synchronized essentially with the movements of the reaching-in elements (7, 8).

3. Gripper weaving machine according to claim 1, characterized in that a separating lever (14) for guiding and positioning the respective weft thread (3, 4) is pivotably arranged near a suction opening (30) of the suction chambers (12, 13), and in that the separating lever (14) is actuatable essentially synchronously with the pivoting flap (11) so that the weft thread ends can be grasped and held tight separately from one another.

4. Gripper weaving machine according to claim 1, characterized in that the reaching-in elements (7, 8) are embodied as reaching-in needles with eyelets for guiding the weft threads (3, 4, 43, 44).

5. Gripper weaving machine according to claim 1, characterized in that the suction chamber block (20) is embodied to be pivotably movable.

6. Gripper weaving machine according to claim 5, characterized in that the suction chamber block (20) comprises an essentially circular shaped or circular segment shaped cross-section, and the individual suction chambers (21, 22, 23, 24) comprise an essentially circular segment shaped cross-section.

7. Gripper weaving machine for multicolor weaving, with which two weft threads pulled off from different bobbins are sequentially one after another inserted by at least one gripper into a loom shed formed of warp threads and are cut-off on the insertion side by a separating device, with two driven reaching-in elements that position, in the running path of the gripper, the weft thread that is respectively to be inserted, and with an arrangement for grasping and holding the weft thread ends remaining on the bobbins after the cutting-off, whereby these weft thread ends are grasped and held separately from one another, and for the insertion of a weft thread selectively one of the two weft threads is brought into the running path of the gripper by one of the reaching-in elements, while the other weft thread is held outside of the running path, characterized in that a) a suction chamber block (10) is provided as the arrangement for the grasping and holding of the weft thread ends remaining on the bobbins (1, 2) after the cutting-off, wherein the suction chamber block is divided into two suction chambers (12, 13) which respectively grasp one weft thread (3, 4) and hold it, and each of which is allocated to a certain weft thread end, and b) two suction chambers (12, 13) are made ready by a movable element that comprises a pivoting flap (11) provided in the interior of the suction chamber block (10).

8. Gripper weaving machine according to claim 7, characterized in that the pivoting flap (11) can be switched-over in a controlled manner, and the controlled switching-over of the pivoting flap (11) is synchronized essentially with the movements of the reaching-in elements (7, 8).

9. Gripper weaving machine according to claim 7, characterized in that a separating lever (14) for guiding and positioning the respective weft thread (3, 4) is pivotably arranged near a suction opening (30) of the suction chambers (12, 13), and in that the separating lever (14) is actuatable essentially synchronously with the pivoting flap (11) so that the weft thread ends can be grasped and held tight separately from one another.

10. Gripper weaving machine according to claim 7, characterized in that the reaching-in elements (7, 8) are embodied as reaching-in needles with eyelets for guiding the weft threads (3, 4, 43, 44).

11. Gripper weaving machine according to claim 7, characterized in that the suction chamber block (10) is divided by the pivoting flap (11) into the two suction chambers (12, 13).

* * * * *